US005787850A

United States Patent [19]

Speil et al.

[11] Patent Number: 5,787,850

[45] Date of Patent: Aug. 4, 1998

[54] HYDRAULIC CLEARANCE COMPENSATION ELEMENT

[75] Inventors: Walter Speil, Ingolstadt; Dieter Schmidt, Nürnberg, both of Germany

[73] Assignee: Ina Walzlager Schaeffler KG, Germany

[21] Appl. No.: 892,838

[22] Filed: Jul. 15, 1997

[30] Foreign Application Priority Data

Jul. 27, 1996 [DE] Germany ..... 196 30 443.1

[51] Int. Cl.[6] ..... F01L 1/24

[52] U.S. Cl. ..... 123/90.55; 123/90.57; 74/569

[58] Field of Search ..... 123/90.48, 90.49, 123/90.52, 90.55, 90.57; 74/569

[56] References Cited

U.S. PATENT DOCUMENTS

| | | | |
|---|---|---|---|
| 4,184,464 | 1/1980 | Svihlik | 123/90.57 |
| 4,638,772 | 1/1987 | Burandt | 123/90.6 |
| 4,721,076 | 1/1988 | Goppelt et al. | 123/90.57 |
| 4,807,576 | 2/1989 | Sonoda et al. | 123/90.57 |
| 4,951,619 | 8/1990 | Schaeffler | 123/90.55 |
| 5,408,959 | 4/1995 | Speil | 123/90.55 |
| 5,622,147 | 4/1997 | Edelmayer | 123/90.55 |

FOREIGN PATENT DOCUMENTS

| | | |
|---|---|---|
| 190418 | 8/1986 | European Pat. Off. . |
| 4111704 | 10/1991 | Germany . |

OTHER PUBLICATIONS

Sonoda, "Hydraulic Tappet for Internal Combustion Engine", Patent Abstracts of Japan, M-628, Apr. 1987, vol. 11/No. 301 Abstract No. 54 (Translation).

*Primary Examiner*—Weilun Lo

*Attorney, Agent, or Firm*—Bierman, Muserlian and Lucas

[57] ABSTRACT

The clearance compensation element (1) of the invention which can be installed, for example, in a valve drive of an internal combustion engine has a certain idle stroke function for undesired overpressure states of its high pressure chamber (12) during a base circle phase of the actuating cam. According to the invention, a valve means (14) such as a ball which closes the high pressure chamber (12) in the direction of a reservoir (10) is freely movable within certain limits. The ball (14), while being extremely light, closes the valve seat bore (13) with the shortest possible stroke immediately upon commencement of the opening ramp ($A_N$) of the cam.

10 Claims, 2 Drawing Sheets

HYDRAULIC CLEARANCE COMPENSATION ELEMENT

FIELD OF THE INVENTION

The invention concerns a hydraulic clearance compensation element, particularly for a valve drive of an internal combustion engine.

BACKGROUND OF THE INVENTION

Hydraulic clearance compensation elements are well-known in the art and therefore do not need to be described in any detail here. As a rule, the valve means of such elements is biased towards the oil reservoir by a spring means. The amount of hydraulic medium pressed out of the high pressure chamber of the clearance compensation element during a high pressure phase of the clearance compensation element is re-sucked into the high pressure chamber through a valve seat bore and through the open valve means during a base circle phase of the cam. Thus, a compensation of all undesired plays occurring in the valve drive takes place in this phase. If undesired, repeated loading and relieving of the clearance compensation element occurs during the base circle phase (play=0) caused, for example, by transverse vibrations of the camshaft or by non-circularities of the base circle of the cam, or for other reasons, this can lead to a pumping-up of the clearance compensation element and thus to a "rigidification" of the high pressure chamber. This "rigidification" can result in an uncontrolled relieving of the gas exchange valve actuated by the clearance compensation element. In the most unfavorable of cases, the gas exchange valve concerned even opens during the base circle phase.

Since this drawback is known in the art, and ever stricter laws force engine manufacturers to improve the quality of exhaust gases, efforts have been made to eliminate this deficiency, among other things, by designing the clearance compensation element to be slightly elastic during the base circle phase. To achieve this effect, it has been proposed to arrange yielding members such as pistons on the high pressure chamber or to provide elastically deformable buffers in association with the camshaft. Such measures, however, involve high manufacturing costs because extremely narrow tolerances have to be respected and it is not guaranteed that they will remain unchanged over the lifetime of the clearance compensation element. Moreover, the desired effect can only be achieved with an unnecessary increase of components in the valve drive whose mass is thus also unnecessarily increased.

The occurrence of undesired relieving of the valve drive, which leads to an undesired opening of the gas exchange valves during the base circle phase, is further promoted by the drastic reduction of valve spring forces undertaken with the aim of reducing friction in the valve drive to a minimum. Generally speaking, the aforesaid unfavorable operating conditions can lead to an erratic running of the engine and to a more harmful exhaust gas mixture as well as to misfiring.

OBJECTS OF THE INVENTION

It is an object of the invention to provide an improved hydraulic clearance compensation element of the pre-cited type while eliminating the mentioned drawbacks.

Another object of the invention is provide the clearance compensation element with a certain elasticity in the base circle phase using inexpensive means while at the same time assuring a very rapid and reliable closing of the valve means (ball) at the commencement of cam lift.

These and other objects and advantages of the invention will become obvious from the following detailed description.

SUMMARY OF THE INVENTION

The novel hydraulic clearance compensation element of the invention for a valve drive of an internal combustion engine, comprising a hollow cylindrical housing (4) closed at one end (22) by a bottom (5), a pressure piston (8) arranged for axial displacement in a bore (7) of the housing (4), a high pressure chamber (12) for hydraulic medium which extends between a bottom-proximal end face (11) of the pressure piston (8) and the bottom (5) of the housing (4), a supply of hydraulic medium to the high pressure chamber (12) from a reservoir (10) which is enclosed in the pressure piston (8), and a valve seat bore (13) arranged in the bottom end face (11) of the pressure piston (8) which faces the high pressure chamber (12), an end of the valve seat bore (13) nearer the high pressure chamber (12) being adapted to be closed by a ball means (14) when high pressure prevails, a stroke of the ball (14) towards the high pressure chamber (12) being limited by a retention means (15) and at least one of the pressure piston (8) and the housing (4) being loaded at least indirectly by at least one cam of a camshaft, and the other of the pressure piston (8) and the housing (4) cooperating with an end of at least one gas exchange valve (6), is characterized in that as seen in axial direction, nothing but hydraulic medium is arranged between the ball (14) and the retention means (15), and a ratio between a diameter ($d_K$) of the ball (14), an outer diameter ($d_d$) of the pressure piston (8), a height (h) of a design stroke of the ball (14) between the valve seat bore (13) and the retention means (15), and a lateral freedom of movement (s) of the ball (14) in a direction perpendicular to a longitudinal axis is:

$$d_K^3 \times d_d^2 \times h \times s/2 \leqq 7\times10^2$$

wherein:

$$d_K^3 \leqq 100,\ d_K^3 \times d_d^2 \leqq 1.5\times10^4 \text{ and } d_K^3 \times d_d^2 \times h \leqq 4\times10^3$$

all values being in mm.

The present invention creates a valve means in which the hitherto used closing spring can be dispensed with. When the clearance compensation element is loaded during the base circle phase of the cam, a certain degree of "elasticity" of the tappet and thus of the valve drive is created due to the fact that a part of the hydraulic medium can flow from the high pressure chamber into the reservoir without an unwanted closing of the valve means. The freedom of movement of the ball is optimized to such an extent that a very rapid, reliable and smooth closing action of the ball can be obtained on cam lift. A teaching is delivered to one skilled in the art which enables him to realize an optimum "idle stroke effect" with the clearance compensation element by varying the proposed parameters within the specified ranges noted above. The diameter $d_K$ of the ball is raised to the third power to take into account the strong dependence of the mass of the ball on its diameter. Similarly, the diameter $d_d$ of the pressure piston is raised to the second power to take the strong dependence of pressure on the surface area into account.

To put it in other words, the task of a person skilled in the art is to select the smallest possible dimensions for the mass of the ball and the spacing of the ball from the valve seat bore and the retention means, as also for the freedom of lateral movement of the ball within the limits of the said parameters so that, as a result, a very high force composed of the overpressure developed in the high pressure chamber and the suction action created by the flow of hydraulic medium between the valve seat and the ball is obtained for closing the ball which thus closes rapidly and reliably at a pre-defined point of time.

The measures provided by the invention further assure that, at the transition to the high pressure phase, the ball is in a defined position in the high pressure chamber. The lift curve of the clearance compensation element can be set within a small tolerance range. The invention further requires only a small raise of the opening and closing ramps of the cam with regard to hitherto implemented ramps, so that only a slightly larger amount of valve overlap occurs.

According to a further embodiment of the invention, to guarantee the shortest possible closing motion of the ball even when the clearance compensation element is installed in an inclined position, the ball is loaded by a spring means such as a conical coil spring in a direction opposed to the closing direction. The force of the spring is dimensioned so as to overcome unfavorable ambience effects under all conditions of operation of the internal combustion engine.

In accordance with another embodiment of the invention, the maximum possible stroke of the ball has a very small dimension (≦0.3 mm) and this maximum value includes an addend corresponding to half the permissible tolerance of the design stroke of the ball.

The spring means can comprise an enlarged coil at its end facing the ball, and this provides an excellent fixing and centering of the ball. At the same time, the supporting diameter of the end of the spring means further away from the ball can be configured larger than the diameter of the valve seat bore which means that certain parts of the bore are conical in shape. A separate disc or the like can be used to fix the spring means in the direction of the high pressure chamber.

According to a further embodiment of the invention, the base circle of the cam is depressed by a defined amount corresponding to a loss in lift (intended idle stroke) of the clearance compensation element from the commencement of its high pressure phase till the closing of the valve seat bore by the ball. In this way, when the idle stroke has been overcome by the compressibility of the high pressure chamber, the height of the pressure piston and the housing relative to each other corresponds to that in conventional devices. At the same time, the opening and closing ramps of the cam are raised by a defined amount to compensate for variations in the loss of lift during the closing action of the ball due to manufacturing tolerances of the ball stroke and other factors of influence. Since, however, the pressure piston and the housing sink into each other due to the necessary expulsion of a defined amount of hydraulic medium from the high pressure chamber during cam lift, the closing ramp is raised more than the opening ramp by an the amount corresponding to this sinking-in.

DETAILED DESCRIPTION OF THE DRAWINGS

Figure 1:
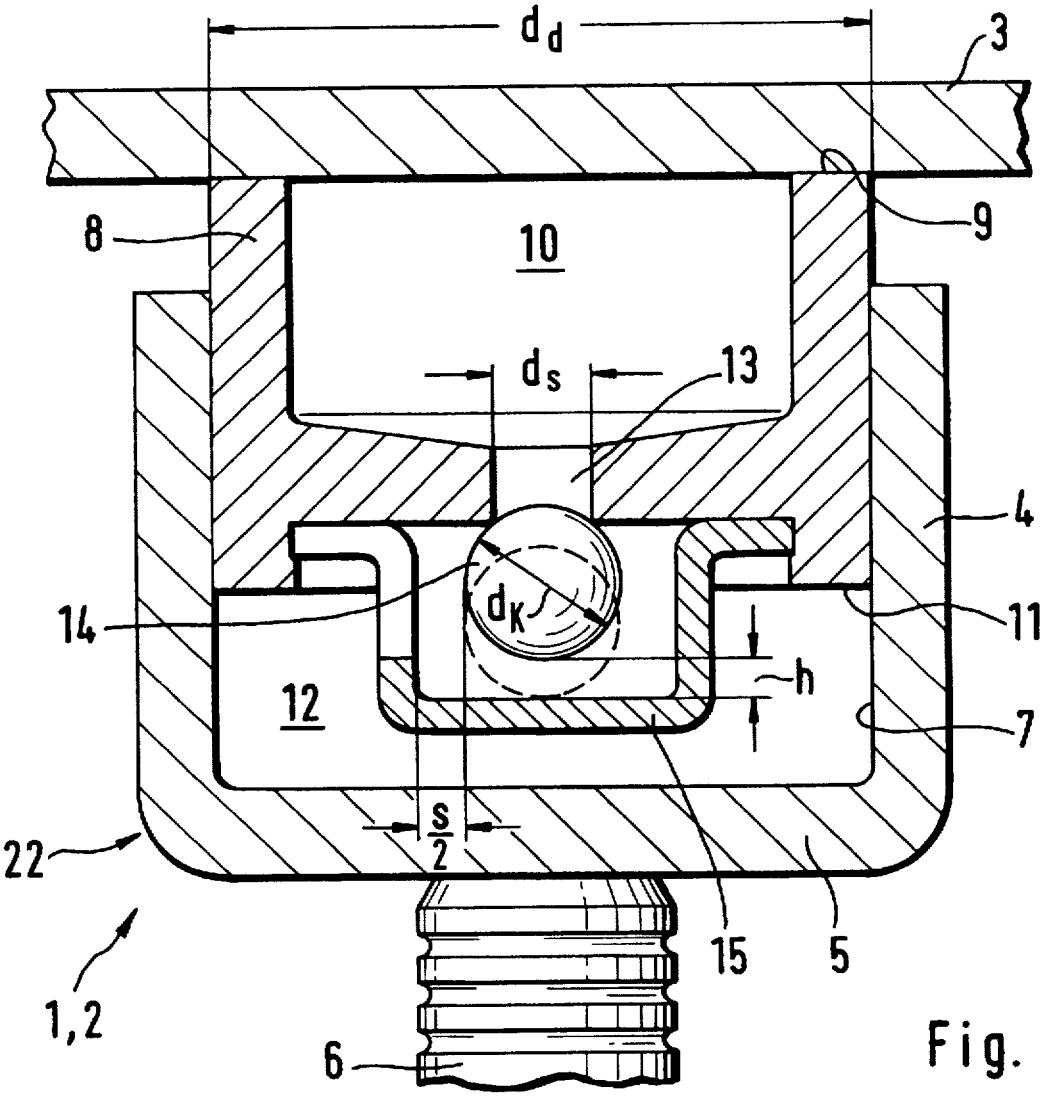
FIG. 1 is a schematic representation of a clearance compensation element as installed in a cup tappet.

FIG. 1 shows a hydraulic clearance compensation element 1 represented schematically in an installed position in a cup tappet 2. In the region of its bottom 3, the cup tappet 2 is loaded in stroke direction by a cam of a camshaft (not shown), while a bottom 5 of a housing 4 of the clearance compensation element 1 acts on an end of a gas exchange valve 6. A pressure piston 8 is arranged for axial displacement in a bore 7 of the clearance compensation element 1. This pressure piston 8 is supported at one end 9 on the bottom 3 of the cup tappet 2 and encloses a reservoir 10 for hydraulic medium.

A high pressure chamber 12 for the hydraulic medium is formed between a bottom 11 of the pressure piston 8 and the bottom 5 of the housing 4. This high pressure chamber 12 is in hydraulic communication with the reservoir 10 through a valve seat bore 13 which is closed at its end nearer the high pressure chamber 12 by a valve means 14 such as a ball. The axial motion of the ball within the high pressure chamber 12 towards the gas exchange valve 6 is limited by a retention means 15 such as a cap. The spring means 14 is freely displaceable between its shown closing position and a second position represented in dashes, and is preferably, not biased in closing direction by a spring means. The method of functioning of such a clearance compensation element 1 will not be described in any detail here because it is sufficiently well-known in the art.

According to the invention, by virtue of its slight free displaceability in the axial direction, the ball 14 has an idle stroke function. A diameter $d_K$ of the ball, a diameter $d_d$ of the pressure piston 8, a height h of a design stroke of the ball 14 between its valve seat bore 13 and the retention means 15, and a lateral free movement s of the ball 14 are configured in accordance with a ratio given above. However, to exclude nonsensical dimensioning, the invention proposes limiting values for the choice of the individual dimensions. Thus, it is guaranteed that by virtue of the "floating" valve means 14, the clearance compensation element 1 fulfils an idle stroke function in the presence of, among other things, non-circularities in the base circle of the cam and transverse vibrations of the camshaft. In this way, a "rigidification" of the high pressure chamber 12 during undesired load peaks in the base circle and an eventually caused unintended opening of the gas exchange valve do not occur. At the same time, the very small stroke h of the ball 14 and its very small mass as provided by the invention assure that the ball 14 closes the valve seat bore 13 at the commencement of the opening ramp $A_N$ immediately after the idle stroke, intended and defined by the invention, has been overcome. The clearance compensation element 1 can then perform its normal function of clearance compensation.

Figure 2:
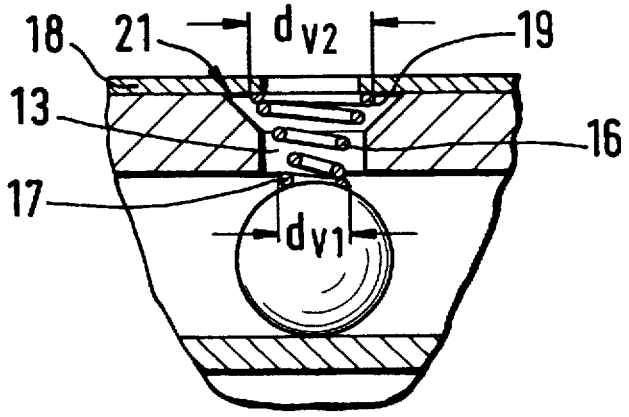
FIG. 2 shows a valve means loaded in a direction opposite to the closing direction by a spring means.

FIG. 2 shows that the ball 14 can be loaded by a spring means 16 such as a conical coil spring in a direction opposed to its closing direction. This measure is particularly useful if the clearance compensation element 1 is not installed parallel to the plumb line in the internal combustion engine. In this state, due to its lateral freedom of movement, the ball 14 would require a stochastically varying time period to reach the valve seat bore 13 at the commencement of the opening ramp $A_N$ of the cam. However, the spring means 16 imposes a stroke h of constant length on the ball 14 in all conditions. An outer diameter $d_{V1}$ of the last coil 17 of the spring means 16 at a ball-side end can be larger than that of the adjacent coils but smaller than a diameter $d_S$ of the valve seat bore 13. This results in an excellent positioning of the ball 14. The last coil 19 of the spring means 16 at its reservoir-side end can be fixed on a stop means 18 such as a retention disc. As can be seen further in FIG. 2, the outer diameter $d_{V2}$ of the last coil 19 is larger than the ball-side diameter of the valve seat bore 13.

Figure 3:
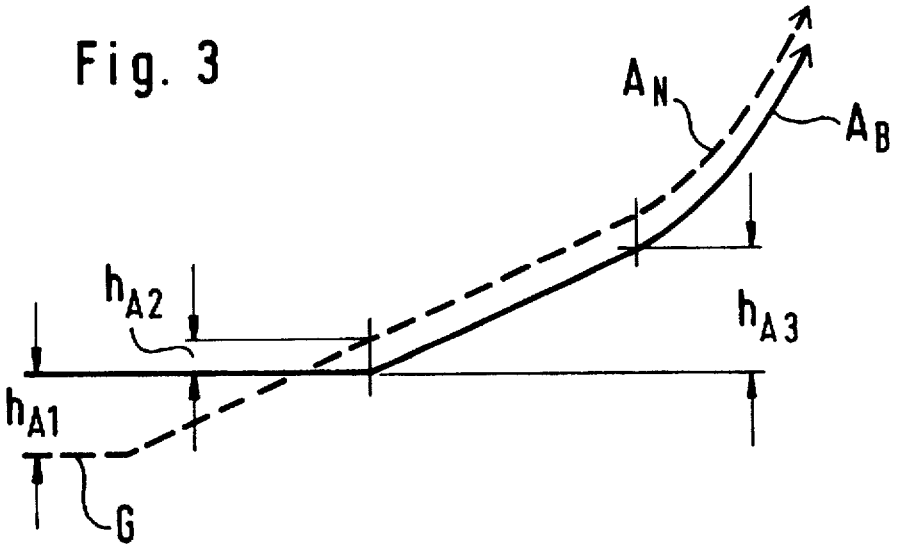
FIGS. 3 and 4 are diagrams showing advantageous opening and closing ramps respectively, of a cam of the invention compared to a conventional cam.
Figure 4:
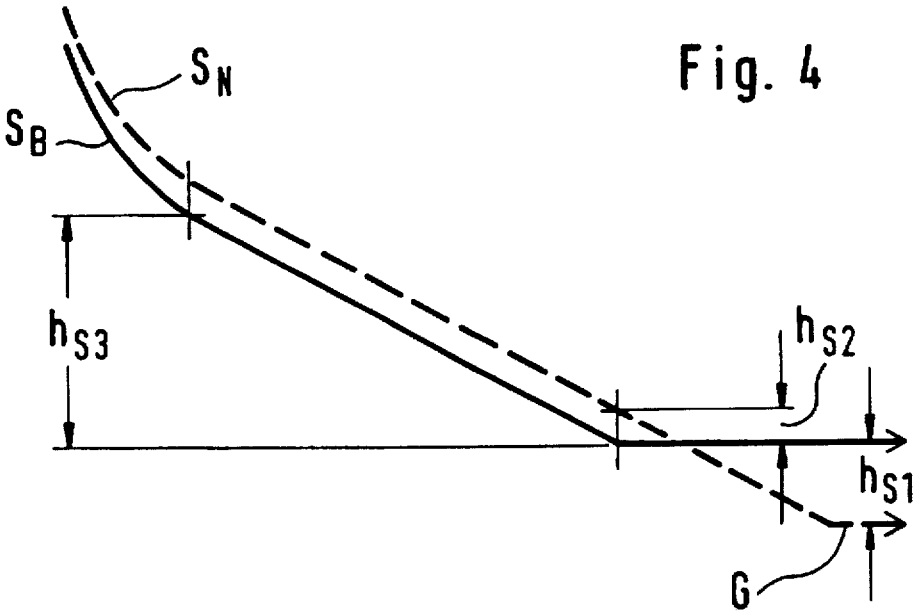

FIGS. 3 and 4 are strongly simplified graphs showing advantageous configurations of the lift curves of an opening and a closing ramp, $A_N$ and $S_N$ respectively, of the cam wherein the means of the invention are implemented.

FIG. 3 shows more particularly that the base circle G is depressed by the amount $h_{A1}$ of the base circle before the commencement of the opening ramp $A_N$. The opening ramp $A_N$ of the cam of the invention is higher than the opening ramp $A_S$ of the prior art cam, the latter having a height of only $h_{A3}$ compared to a height $h_{A2}$ $h_{A3}$ of the opening ramp of the cam of the invention. Due to this depression of the base circle, a loss of lift of the clearance compensation element 1 from the beginning of its high pressure phase until the closing of the valve seat bore by the ball 14 is compensated by the elasticity of the clearance compensation element 1 as a whole. The opening ramp $A_N$ which follows directly in the direction of rotation is at the same time raised by an amount $h_{A2}$ to compensate for variations in the loss of lift during the closing action of the ball 14 due to manufacturing tolerances and other factors of influence. An analogous raising of the closing ramp $S_N$ which precedes the base circle G in the direction of rotation is shown in FIG. 4. In FIG. 4, the closing ramp $S_N$ of the cam of the invention is higher than the closing ramp $S_B$ of the prior art cam for the same reasons as in FIG. 3.

FIG. 4 does not show specifically that the closing ramp $S_N$ is raised slightly more than the opening ramp $A_N$ because, as described above, the pressure piston 8 and the housing 4 sink into each other to a certain extent during cam lift, and this sinking-in has to be compensated. The measures of the invention also guarantee that the increase in length of the opening and closing ramps, $A_N$ and $S_N$, resulting from the raising is kept to the required minimum.

In a preferred embodiment of the invention, a maximum possible stroke ($h_{max}$) of the ball (14) between the valve seat bore (13) and the retention means (15) is given by:

$$h_{max}(mm)=h(mm)+\Delta h(mm)\leqq 0.3$$

wherein $\Delta h$ is half of a permissible tolerance of the design stroke of the ball (14) and $h/\Delta h$ is determined as:

$$1.3\leqq h/\Delta h\leqq 10.$$

In another preferred embodiment of the invention, the outer diameter ($d_{V1}$) of the end coil (17) is determined as:

$$d_{V1}(mm)\leqq d_S-S(mm)$$

wherein $d_S$ is a diameter of the valve seat bore (13), and an outer diameter ($d_{V2}$) of an end coil (19) of the spring means (16) nearer the reservoir (10) is determined as:

$$d_{V2}\ (mm)\geqq d_S\ (mm).$$

In the clearance compensation element, seen in a direction of rotation of the cam, a base circle (G) of the cam immediately preceding an opening ramp ($A_N$) of the cam is depressed by an amount ($h_{A1}$) which corresponds to a loss of lift of the clearance compensation element (1) from a commencement of a high pressure phase thereof (opening ramp $A_N$) till a closing of the valve seat bore (13) by the ball (14), the opening ramp ($A_N$) and a closing ramp ($S_N$) which precedes the base circle (G) in the direction of rotation of the cam are raised by an amount ($h_{A2}$ and $h_{S2}$ respectively) which corresponds to a variation of the loss of lift during a closing action of the ball (14) due to manufacturing tolerances in the stroke of the ball (14) and other, engine-dependent factors of influence, and the closing ramp ($S_N$) is raised more than the opening ramp ($A_N$) by an amount corresponding to a maximum sinking of the pressure piston (8) relative to the housing (4) during cam lift.

Various modifications of the hydraulic clearance compensation element of the invention may be made without departing from the spirit or scope thereof and it should be understood that the invention is intended to be limited only as defined in the apended claims.

We claim:

1. A hydraulic clearance compensation element (1) for a valve drive of an internal combustion engine, comprising a hollow cylindrical housing (4) closed at one end (22) by a bottom (5), a pressure piston (8) arranged for axial displacement in a bore (7) of the housing (4) , a high pressure chamber (12) for hydraulic medium which extends between a bottom-proximal end face (11) of the pressure piston (8) and the bottom (5) of the housing (4), a supply of hydraulic medium to the high pressure chamber (12) from a reservoir (10) which is enclosed in the pressure piston (8), and a valve eat bore (13) arranged in the bottom end face (11) of the pressure piston (8) which faces the high pressure chamber (12), an end of the valve seat bore (13) nearer the high pressure chamber (12) being adapted to be closed by a ball means (14) then high pressure prevails, a stroke of the ball (14) towards the high pressure chamber (12) being limited by a retention means (15) and at least one of the pressure piston (8) and the housing (4) being loaded at least indirectly by at least one cam of a camshaft, and the other of the pressure piston (8) and the housing (4) cooperating with an end of at least one gas exchange valve (6), characterized in that as seen in an axial direction, nothing but hydraulic medium is arranged between the ball (14) and the retention means (15), and a relationship between a diameter ($d_K$) of the ball (14), an outer diameter ($d_d$) of the pressure piston (8), a height (h) of a design stroke of the ball (14) between the valve seat bore (13) and the retention means (15), and a lateral freedom of movement (s) of the ball (14) in a direction perpendicular to a longitudinal axis is:

$$d_K^3\times d_d^2\times h\times s/2\leqq 7\times 10^2$$

wherein:

$d_K^3\leqq 100$, $d_K^3\times d_d^2\leqq 1.5\times 10^4$ and $d_K^3\times d_d^2\times h\leqq 4\times 10^3$ all values being in mm.

2. A clearance compensation element of claim 1 wherein, when the clearance compensation element (1) is installed in an inclined position with respect to the direction of gravity, the ball (14) is loaded in an opening direction by a mechanical spring means (16).

3. A clearance compensation element of claim 2 wherein the spring means (16) is designed with a force that is equal to or larger than a mass force of the ball (14) at 10 g.

4. A clearance compensation element of claim 1 wherein a maximum possible stroke ($h_{max}$) of the ball (14) between the valve seat bore (13) and the retention means (15) is given by:

$$h_{max}(mm)=h(mm)+\Delta h(mm)\leqq 0.3$$

wherein Δh is half of a permissible tolerance of the design stroke of the ball (14) and h/Δh is determined as:

$$1.3\leqq h/\Delta h\leqq 10.$$

5. A clearance compensation element of claim 2 wherein the spring means (16) is a conical coil spring whose smaller end is positioned towards the ball (14).

6. A clearance compensation element of claim 5 wherein at an end (21) of the valve seat bore (13) nearer the reservoir (10), the spring means (16) is supported on a stop means (18).

7. A clearance compensation element of claim 6 wherein the stop means (18) is a retention disc.

8. A clearance compensation element of claim 2 wherein an outer diameter ($d_{V1}$) of an end coil (17) of the spring means (16) nearer the ball (14) is larger than a diameter of adjoining coils.

9. A clearance compensation element of claim 8 wherein the outer diameter ($d_{V1}$) of the end coil (17) is determined as:

$$d_{V1}(mm)\leqq d_S-(mm)$$

wherein $d_S$ is a diameter of the valve seat bore (13), and an outer diameter ($d_{V2}$) of an end coil (19) of the spring means (16) nearer the reservoir (10) is determined as:

$$d_{V2}(mm)\geqq d_S\ (mm).$$

10. A hydraulic clearance compensation element (1) for a valve drive of an internal combustion engine, comprising a hollow cylindrical housing (4) closed at one end (22) by a bottom (5), a pressure piston (8) arranged for axial displacement in a bore (7) of the housing (4), a high pressure chamber (12) for hydraulic medium which extends between a bottom-proximal end face (11) of the pressure piston (8) and the bottom (5) of the housing (4), a supply of hydraulic medium to the high pressure chamber (12) from a reservoir (10) which is enclosed in the pressure piston (8), and a valve seat bore (13) arranged in the bottom end face (11) of the pressure piston (8) which faces the high pressure chamber (12), an end of the valve seat bore (13) nearer the high pressure chamber (12) being adapted to be closed by a ball means (14) when high pressure prevails, a stroke of the ball (14) towards the high pressure chamber (12) being limited by a retention means (15) and at least one of the pressure piston (8) and the housing (4) being loaded at least indirectly by at least one cam of a camshaft, and the other of the pressure piston (8) and the housing (4) cooperating with an end of at least one gas exchange valve (6), nothing but hydraulic medium is arranged between the ball (14) and the retention means (15), characterized in that as seen in the axial direction of the camshaft, a base circle (G) of the cam immediately preceding an opening ramp ($A_N$) of the cam is depressed by an amount ($h_{A1}$) which corresponds to a loss of lift of the clearance compensation element (1) from a commencement of a high pressure phase thereof (opening ramp $A_N$) and a closing ramp ($S_N$) which precedes the base circle (G) in the direction of rotation of the cam are raised by an amount ($h_{A2}$ and $h_{B2}$ respectively) which corresponds to a variation of the loss of lift during a closing action of the ball (14) due to manufacturing tolerances in the stroke of the ball (14) and other, engine-dependent factors of influence, and the closing ramp ($S_N$) is raised more than the opening ramp ($A_N$) by an amount corresponding to a maximum sinking of the pressure piston (8) relative to the housing (4) during cam lift and as seen in axial direction, and a relationship between a diameter ($d_K$) of the ball (14), an outer diameter ($d_d$) of the pressure piston (8), a height (h) of a design stroke of the ball (14) between the valve seat bore (13) and the retention means (15), and a lateral freedom of movement (s) of the ball (14) in a direction perpendicular to a longitudinal axis is;

$$d_K^3\times d_d^2\times h\times s/2\leqq 7\times 10^2$$

wherein:

$d_K^3\leqq 100$, $d_K^3\times d_d^2\leqq 1.5\times 10^4$ and $d_K^3\times d_d^2\times h\leqq 4\times 10^3$ all values being in mm.

* * * * *